US009174437B2

(12) United States Patent
Hagiwara et al.

(10) Patent No.: US 9,174,437 B2
(45) Date of Patent: Nov. 3, 2015

(54) LIQUID EJECTING APPARATUS

(71) Applicant: Seiko Epson Corporation, Tokyo (JP)

(72) Inventors: Hiroyuki Hagiwara, Matsumoto (JP); Haruhisa Uezawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 71 days.

(21) Appl. No.: 14/192,635

(22) Filed: Feb. 27, 2014

(65) Prior Publication Data

US 2014/0240386 A1 Aug. 28, 2014

(30) Foreign Application Priority Data

Feb. 28, 2013 (JP) ..... 2013-038454

(51) Int. Cl.
*B41J 2/07* (2006.01)
*B41J 2/045* (2006.01)

(52) U.S. Cl.
CPC ..... *B41J 2/072* (2013.01); *B41J 2/04553* (2013.01); *B41J 2/04563* (2013.01); *B41J 2/04581* (2013.01)

(58) Field of Classification Search
USPC ..... 347/9–19
See application file for complete search history.

(56) References Cited

U.S. PATENT DOCUMENTS 5,006,867 A * 4/1991 Koizumi et al. ..... 347/17
5,646,655 A * 7/1997 Iwasaki et al. ..... 347/17
6,145,949 A 11/2000 Takahashi
6,331,039 B1 * 12/2001 Iwasaki et al. ..... 347/11
8,240,804 B2 * 8/2012 Tanaka et al. ..... 347/17
8,651,607 B2 * 2/2014 Ihara ..... 347/14
8,915,584 B2 * 12/2014 Ihara ..... 347/100
2002/0140752 A1 10/2002 Pulman et al.
2010/0238226 A1 * 9/2010 Tanaka et al. ..... 347/17

FOREIGN PATENT DOCUMENTS

JP 3418185 B2 4/2003
JP 3674248 B2 5/2005

* cited by examiner

*Primary Examiner* — Matthew Luu
*Assistant Examiner* — Lily Kemathe
(74) *Attorney, Agent, or Firm* — Kilpatrick Townsend & Stockton LLP

(57) ABSTRACT

Provided is a liquid ejecting apparatus including a first temperature sensor for detecting ink temperature and a second temperature sensor for detecting ambient temperature of a liquid ejecting head, in which a controller for controlling discharge of the ink generates a driving signal including a discharge voltage which is used for, based on a temperature detected by the first temperature sensor, discharging ink droplets through nozzle openings and a fine-oscillation voltage which is used for finely oscillating meniscuses of the ink without discharging the ink droplets and corresponds to the discharge voltage. Furthermore, the controller sets a coefficient in accordance with a temperature difference between the ink temperature and the ambient temperature and controls an energy level of the fine oscillation by applying the fine-oscillation voltage, based on the coefficient. In addition, the controller causes the discharge voltage to be applied to a pressure generation unit corresponding to the nozzle openings through which the ink droplets are discharged and causes the fine-oscillation voltage to be applied to a pressure generation unit corresponding to the nozzle openings through which the ink droplets are not discharged.

6 Claims, 7 Drawing Sheets

LIQUID EJECTING APPARATUS

This application claims priority to Japanese Patent Application No. 2013-038454, filed Feb. 28, 2013, the entirety of which is incorporated by reference herein.

BACKGROUND

1. Technical Field

The present invention relates to a liquid ejecting apparatus. Particularly, the invention is effective when applied to a case where, in addition to a discharge voltage used for discharging ink droplets, a fine-oscillation voltage used for causing fine oscillation without discharging ink droplets is applied to heat liquid in a pressure generation chamber which corresponds to non-discharging nozzles.

2. Related Art

An ink-jet type recording head (also referred to as a recording head, hereinafter) in which ink droplets are discharged through a plurality of nozzle openings by using pressure owing to displacement of a piezoelectric element has been known as a representative example of a liquid ejecting head, for example. Also, an ink-jet type recording apparatus equipped with the ink-jet type recording head described above has been known as an example of the liquid ejecting apparatus.

In the case of a recording head applied to the ink-jet type recording apparatus described above, there is a tendency that the temperature of the ink in a pressure generation chamber corresponding to non-discharging nozzles, out of the plurality of the nozzle openings forming nozzle arrays, through which the ink droplets are not discharged is lower than the temperature of the ink in a pressure generation chamber corresponding to discharging nozzles through which the ink droplets are discharged. The reason for this is that the ink in the pressure generation chamber corresponding to the discharging nozzles is replaced and is subjected to heat-exchange due to heat energy converted from part of oscillation energy which is generated by driving of a pressure generation unit.

When the ink temperature varies as described above, a discharge property of the ink discharged through each nozzle opening, particularly, a weight variation of the discharged ink, is caused due to a viscosity variation of the ink, for example.

In recent years, high-quality and high-resolution have been required for a recorded matter. With the trend toward high-quality and high-resolution, a method in which, in addition to a driving signal used for discharging ink droplets, a fine-oscillation signal is applied to the pressure generation unit corresponding to non-discharging nozzles such that meniscuses are finely oscillated without discharging the ink, and thus heat is generated has been proposed.

In many cases of the fine-oscillation signal supply methods of the related art, a waveform of the fine-oscillation signal is determined such that as much energy as some percentage of the energy induced by a discharge driving signal is applied under consideration of the discharge driving signal. Accordingly, the fine-oscillation signal is not always appropriately generated, and thus it is difficult to say that a fine-oscillation driving signal is appropriate to any operation condition of the recording head.

Examples of patent literature in which the ink temperature difference between the non-discharging nozzles and the discharging nozzles is reduced by applying fine oscillation include Japanese Patent No. 3418185 and No. 3674248.

However, in the case of technology disclosed in Japanese Patent No. 3418185 and No. 3674248, a problem that the ink temperature is greatly affected by ambient temperature and this is particularly remarkable in the non-discharging nozzles is not sufficiently considered. In other words, in the case of the technology disclosed in Japanese Patent No. 3418185 and No. 3674248, the fine-oscillation signal is difficult to be optimized, with respect to the discharge driving signal while sufficiently considering the ambient temperature and the ink temperature, to allow the ink temperature of the non-discharging nozzles to be always matched to the ink temperature of the discharging nozzles as much as possible.

This problem is not limited to the ink-jet type recording head discharging ink but common to a liquid ejecting head discharging other liquids.

SUMMARY

An advantage of some aspects of the invention is to provide a liquid ejecting apparatus in which a fine-oscillation energy level is optimized with an ambient temperature and a liquid temperature as parameters and in which the liquid temperature of discharging nozzles can be matched to the liquid temperature of non-discharging nozzles as much as possible and a predetermined operation, such as printing, can be performed while suppressing erroneous ink discharge and preventing a reduction in a printing speed.

To achieve the advantage described above, according to an aspect of the invention, there is provided a liquid ejecting apparatus that has a liquid ejecting head in which pressure in each pressure generation chamber is changed by each of a plurality of pressure generation units, and thus liquid in the pressure generation chamber is discharged, as liquid droplets, through nozzle openings and that has a controller including a driving signal generation unit which generates a driving signal used for operating the pressure generation units. The liquid ejecting apparatus includes a first temperature sensor that detects temperature of the liquid, and a second temperature sensor that detects ambient temperature of the liquid ejecting head. In the liquid ejecting apparatus, the controller generates a driving signal including a discharge voltage which is used for, based on a temperature detected by the first temperature sensor, discharging the liquid droplets through the nozzle openings and a fine-oscillation voltage which is used for finely oscillating meniscuses of the liquid without discharging the liquid droplets and corresponds to the discharge voltage. Furthermore, the controller sets a coefficient in accordance with a temperature difference between the temperature of the liquid detected by the first temperature sensor and the ambient temperature detected by the second temperature sensor and controls an energy level of the fine oscillation by applying the fine-oscillation voltage, based on the coefficient. In addition, the controller causes the discharge voltage to be applied to the pressure generation unit corresponding to nozzle openings through which the liquid droplets are discharged and causes the fine-oscillation voltage to be applied to the pressure generation unit corresponding to nozzle openings through which the liquid droplets are not discharged.

According to the aspect described above, the coefficient is set, based on data evaluated in advance, using the temperature difference between the liquid temperature and the ambient temperature, and the fine-oscillation voltage corresponding to the discharge voltage is determined based on the coefficient. Accordingly, it is possible to control the energy level of the fine oscillation by applying the fine-oscillation voltage.

As a result, it is possible to match the liquid temperature of the discharging nozzles to the liquid temperature of the non-discharging nozzles as much as possible. Therefore, the variation in liquid-droplet discharging properties is suppressed by appropriately heating the liquid by applying the fine oscillation, and thus high-quality and high-resolution of a recorded matter can be achieved.

In the liquid ejecting apparatus, it is preferable that the driving signal include a corrected fine-oscillation voltage of which a voltage value is changed by multiplying a reference fine-oscillation voltage corresponding to the discharge voltage by the coefficient and control the energy level of the fine oscillation by applying the corrected fine-oscillation voltage. Alternatively, it is preferable that the driving signal control the energy level of the fine oscillation by applying the fine-oscillation voltage in such a manner that the number of application times of the fine-oscillation voltage within a predetermined period is changed in accordance with the coefficient. The reason for this is that, in either case, it is possible to easily control the energy level of the fine oscillation by reflecting the predetermined coefficient.

In the liquid ejecting apparatus, it is preferable that a proportionality constant be determined based on a relationship of (a second temperature difference $\Delta T2$)=k·(a first temperature difference $\Delta T1$) which is established between the first temperature difference between the liquid temperature detected by the first temperature sensor and the ambient temperature detected by the second temperature sensor and the second temperature difference between the liquid temperature detected by the second temperature sensor and a nozzle-plate temperature detected separately and in which k is the proportionality constant. Furthermore, it is preferable that the liquid temperature and the ambient temperature be measured by the first and second temperature sensors and a measured value of the first temperature difference be obtained based on the measured data, and thus the second temperature difference be calculated using the measured value of the first temperature difference and the proportionality constant, and the coefficient be determined to meet a condition in which temperature of the liquid droplets discharged through the nozzle openings is a value obtained by adding the calculated value of the second temperature difference to the measured value of the liquid temperature, which is a value detected by the first temperature sensor, or subtracting the calculated value of the second temperature difference from the measured value of the liquid temperature. In this case, it is also possible to optimize the oscillation energy level of the fine oscillation because the temperature of the liquid droplets discharged through the nozzle openings can be accurately reflected in the coefficient.

In the liquid ejecting apparatus, it is preferable that the fine-oscillation voltage be controlled to be set in the range of between a lower voltage limit for preventing thickening of liquid and an upper voltage limit for preventing erroneous liquid discharge through the nozzle openings. In this case, the fine oscillation can appropriately be applied to effectively prevent the thickening of the liquid and the erroneous liquid discharge.

In the liquid ejecting apparatus, it is preferable that the fine-oscillation voltage be controlled to be set in the range of between a lower voltage limit for preventing thickening of liquid and an upper voltage limit for preventing erroneous liquid discharge through the nozzle openings, and the number of application times of the reference non-discharge voltage within a predetermined period be controlled to be increased, when the fine-oscillation voltage exceeds the upper limit voltage. In this case, a predetermined operation, such as printing, can be performed while suppressing erroneous ink discharge and preventing a reduction in a printing speed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, details of an embodiment of the invention will be described with reference to the accompanying drawings.

Figure 1:
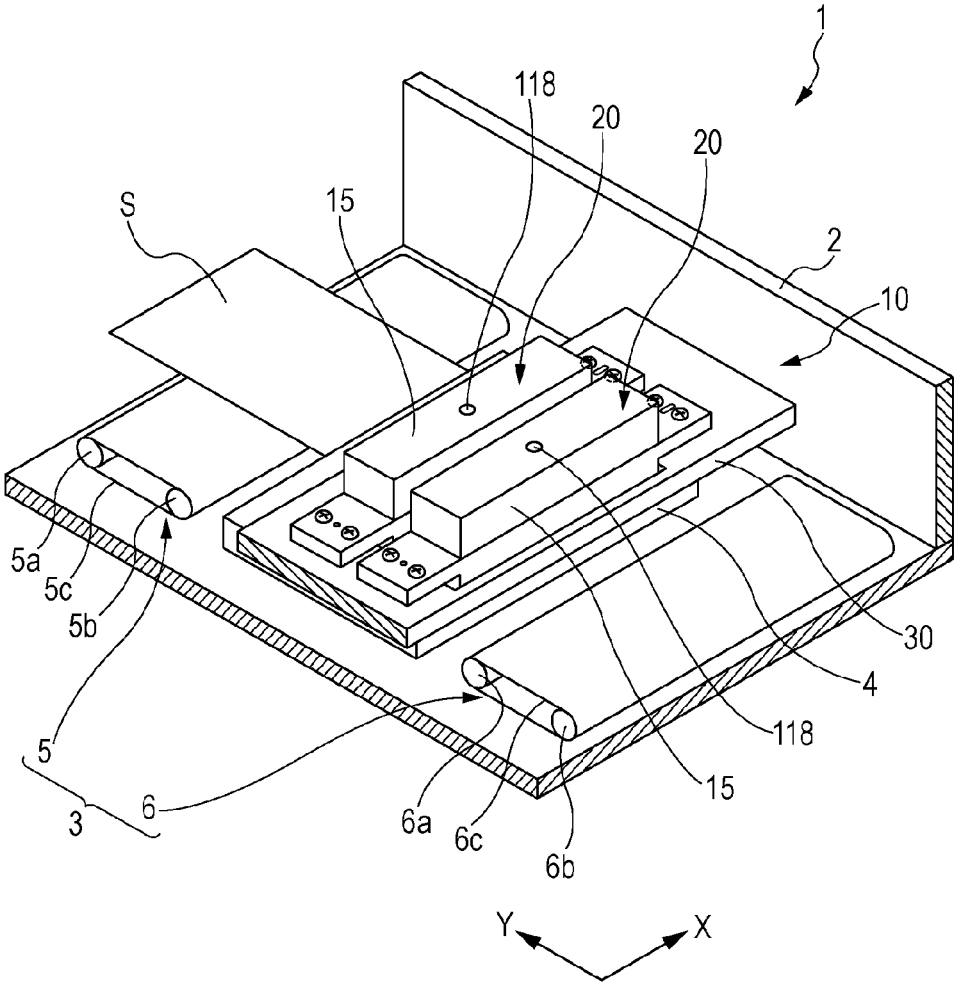
FIG. 1 is a schematic perspective view of an ink-jet type recording apparatus.

FIG. 1 is a schematic perspective view of an ink-jet type recording apparatus according to the embodiment of the invention. An ink-jet type recording apparatus 1 according to this embodiment is a so-called line type recording apparatus in which printing is performed in a manner that an ink-jet type recording head unit 10 is fixed and a recording sheet S as an ejection receiving medium, such as a paper sheet is transported, as illustrated in FIG. 1.

Specifically, the ink-jet type recording apparatus 1 includes an apparatus main body 2, the ink-jet type recording head unit 10 fixed to the apparatus main body 2, a transporting unit 3 that transports the recording sheet S as a recording medium, and a platen 4 that supports a back surface of the recording sheet S, which is opposite a printing surface facing the ink-jet type recording head unit 10.

The ink-jet type recording head unit 10 is fixed to the apparatus main body 2 using a fixing member 30, so that an arrangement direction of nozzle openings (not illustrated in FIG. 1) on a recording head 20 is perpendicular to a transport direction of the recording sheet S. A plurality of the recording heads 20 are positioned and fixed to the fixing member 30.

The transporting unit 3 includes a first transporting unit 5 and a second transporting unit 6 which are respectively located, with respect to the ink-jet type recording head unit 10, at both sides of the recording sheet S in the transport direction. The first transporting unit 5 is constituted by a driving roller 5*a*, a driven roller 5*b*, and a transfer belt 5*c* wound around the driving roller 5*a* and the driven roller 5*b*. In addition, the second transporting unit 6 is constituted by a driving roller 6*a*, a driven roller 6*b*, and a transfer belt 6*c*, similar to the first transporting unit 5. A driving unit, such as a driving motor (not illustrated), is connected to the driving rollers 5*a* and 6*a* of the first transporting unit 5 and the second transporting unit 6. The transfer belts 5*c* and 6*c* are rotationally driven by a driving force of the driving unit, and thus the recording sheet S is transported on an upstream side or a downstream side of the ink-jet type recording head unit 10.

Although the first transporting unit 5 and the second transporting unit 6 which are constituted by the driving rollers 5*a* and 6*a*, the driven rollers 5*b* and 6*b*, and the transfer belts 5*c* and 6*c* are exemplified in this embodiment, a holding unit may be additionally installed to hold the recording sheet S on the transfer belts 5*c* and 6*c*. An electrostatic charging unit that charges an outer circumferential surface of the recording sheet S may be provided as the holding unit, for example, and thus the recording sheet S charged by the electrostatic charging unit may be adhered on the transfer belt 5*c* or 6*c* by a dielectric polarization operation. In addition, pressing rollers as the holding unit may be provided on the transfer belts 5*c* and 6*c*, and thus the recording sheet S may be interposed between the pressing rollers and the transfer belts 5*c* and 6*c*.

The platen 4 is formed of, for example, a metal or a resin-based material of which the cross-section has a rectangular shape and which is provided between the first transporting unit 5 and the second transporting unit 6 to face the ink-jet type recording head unit 10. The platen 4 supports, at the position facing the ink-jet type recording head unit 10, the recording sheet S which is transported by the first transporting unit 5 and the second transporting unit 6.

In addition, a suction unit may be provided in the platen 4 to suck the recording sheet S on the platen 4. Examples of the suction unit include a suction device that causes the recording sheet S to be adhered thereto by sucking, and an electrostatic suction device that causes the recording sheet S to be adhered thereto by using an electrostatic force.

Although not illustrated, an ink storage unit, such as an ink tank or an ink cartridge for storing ink, is connected to the recording head 20 such that the ink storage unit can supply the ink. In the case of this example, the ink storage unit is held at the position different from the position of the ink-jet type recording head unit 10 in the apparatus main body 2 and is connected to an ink supply path 118 of each recording head 20 through a tube or the like. An upper end opening portion of the ink supply path 118 is provided on an upper surface of a head case (a flow-passage member) 15 of the recording head 20.

In this case, a heating device (not illustrated) may be provided in the ink storage unit. When the heating device is provided, it is possible to adjust ink temperature to be maintained at the predetermined temperature by managing a detected temperature obtained from a temperature sensor (not illustrated in FIG. 1) that detects ink temperature, for example.

Figure 2:
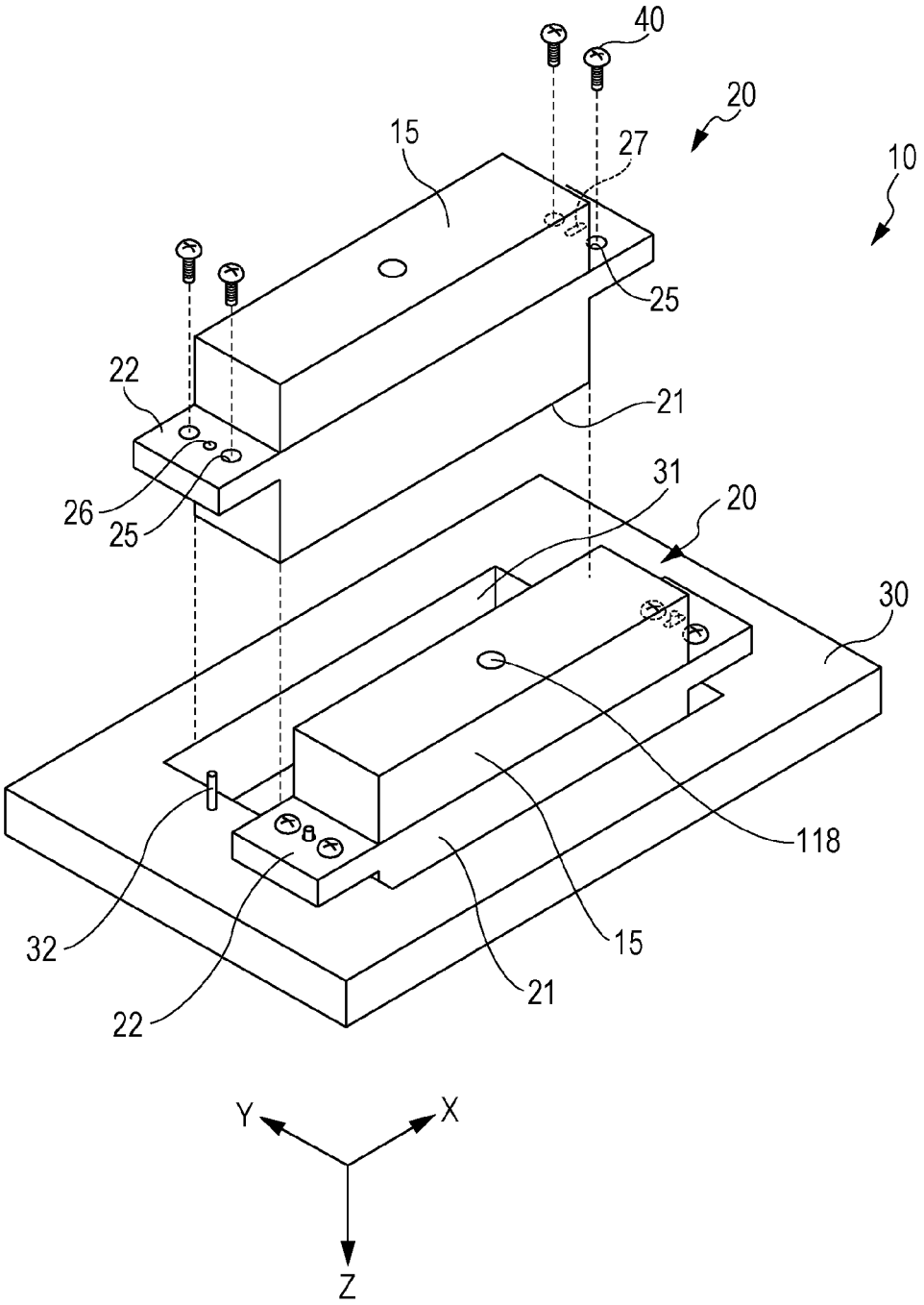
FIG. 2 is a schematic perspective view of an ink-jet type recording head unit.
Figure 3A:
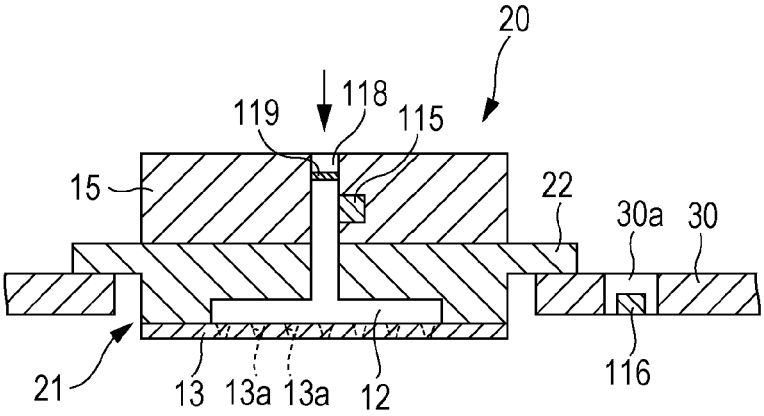
FIGS. 3A and 3B are longitudinal cross-sectional views of the ink-jet type recording head unit.
Figure 3B:
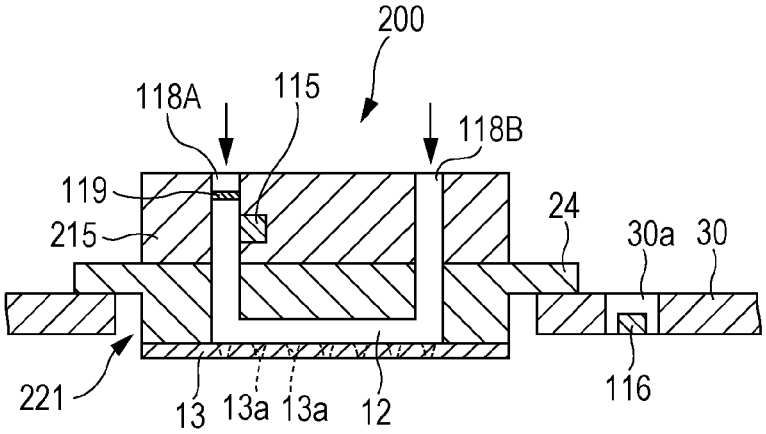

FIG. 2 is a schematic perspective view of the ink-jet type recording head unit according to this embodiment, and FIGS. 3A and 3B are longitudinal cross-sectional views thereof. As illustrated in FIGS. 2 to 3B, the ink-jet type recording head unit 10 includes the plurality of ink-jet type recording heads (also referred to as recording heads, hereinafter) 20 and the fixing member 30 to which the plurality of recording heads 20 are fixed in a positioned state.

In this embodiment, two recording heads 20 are fixed to the fixing member 30. In this case, the recording heads 20 respectively have head main bodies 21 and the head cases 15 as flow-passage members for supplying the ink to a plurality of head main bodies 21. The recording heads 20 are fixed to the fixing member 30 via flange portions 22 formed integrally to the head main bodies 21.

A manifold 12 which communicates with each pressure generation chamber and in which the ink to be supplied is stored is formed in the head main body 21, as illustrated in FIG. 3A. The ink is introduced through the ink supply path 118 provided in the head case 15. On a downstream side of a filter 119 which is provided in the middle of the ink supply path 118, a temperature sensor 115 is provided to be adjacent to the ink supply path 118. Thus, the temperature sensor 115 detects the temperature of the ink flowing through the ink supply path 118. Meanwhile, a temperature sensor 116 is provided in a concave portion 30*a* of the fixing member 30. Thus, the temperature sensor 116 detects the ambient temperature of the head main body 21.

Although not illustrated, a pressure generation chamber which communicates with nozzle openings 13*a* formed on a nozzle plate 13 and a pressure generation unit that causes the ink to be discharged through the nozzle openings 13*a* by generating a pressure change in the pressure generation chamber are provided in the head main body 21. Although not particularly limited, examples of the pressure generation unit include a device using a piezoelectric element that is constituted by a piezoelectric material which exhibits an electromechanical conversion operation and is interposed between two electrodes, a device in which a heating element is provided in the pressure generation chamber and liquid droplets are discharged through the nozzle openings 13*a* by bubbles generated by the heat of the heating element, and a device in which static electricity is generated between a diaphragm and an electrode to deform the diaphragm and liquid droplets are discharged through the nozzle openings 13*a*. In addition, examples of the piezoelectric element include a deflection-oscillation type piezoelectric element in which a lower electrode, a piezoelectric material, and an upper electrode are laminated on a pressure generation chamber side and deflectably deformed, and a longitudinal-oscillation type piezoelectric element in which piezoelectric materials and electrode forming materials are laminated on each other and are extended or contracted in an axial direction.

A positioning hole 26 having a single-hole shape is formed on one side of the flange portion 22 and a positioning hole 27 having an elongated-hole shape is formed on the other side thereof. Incidentally, the single hole mentioned above means a hole of which the opening is formed in a precise-circle shape or a substantially precise-circle shape, and the elongated hole mentioned above means a hole of which the opening is formed in an ellipse shape or a substantially ellipse shape.

The fixing member 30 is formed of a metal or resin-based plate member in which a holding hole 31 is formed. A part of each recording head 20, which is located on a nozzle openings 13*a* side, is inserted into the holding hole 31. The holding hole 31 of the fixing member 30 has an opening of which the width in a second direction Y is slightly larger than the width of two recording heads 20 in the second direction Y. In addition, the holding hole 31 has the opening of which the width in a first direction X is slightly smaller than the width of the flange portion 22 of the recording head 20. Thus, parts of the two recording heads 20, which are located on the nozzle openings 13*a* side, are inserted, from a third direction Z, into the holding hole 31 of the fixing member 30. Furthermore, in the recording head 20 of which a portion located on the nozzle openings 13*a* side is inserted into the holding hole 31, the flange portion 22 abuts on a peripheral portion of the holding hole 31 and is fixed by a fixing unit. In addition, a gap is provided between the recording head 20 and the holding hole 31. This gap allows the recording head 20 to be slightly movable in the first direction X and the second direction Y, with respect to the fixing member 30.

In addition, two recording heads 20 are fixed to the fixing member 30 in a state where the nozzle openings 13*a* of the two recording heads 20 are relatively positioned. Specifically, a positioning pin 32 is provided on each portion around the holding hole 31 of the fixing member 30, on which the flange portion 22 abuts. In other words, a pair of (two) positioning pins 32 is provided for each recording head 20. These positioning pins 32 are respectively inserted into the first positioning hole 26 and the second positioning hole 27 which are provided in the flange portion 22, and thus the two recording head 20 are relatively positioned.

The first positioning hole 26 is a single hole, and thus the first positioning hole 26 conducts positioning of the recording head 20 in the first direction X and the second direction Y. Furthermore, the second positioning hole 27 is an elongated hole, and thus the second positioning hole 27 conducts rotational positioning of the recording head 20 with the first positioning hole 26 as an axis. In other words, the second positioning hole 27 is an elongated hole, and thus it is possible to prevent a problem that the positioning pin 32 cannot be inserted into the second positioning hole 27 due to dimensional tolerance of the fixing member 30 or the recording head 20.

In this embodiment, a fastening member 40 is used as a fixing unit for fixing the recording head 20 to the fixing member 30. The fastening member 40 is a male screw. The fastening member 40 is inserted into a fixing hole 25 provided in the flange portion 22 of the recording head 20, and the tip portion of the fastening member 40 is screwed into the fixing member 30. Therefore, the recording head 20 is fastened to the fixing member 30 by the fastening member 40. In this embodiment, four fixing holes 25 are provided per each recording head 20, and thus four, that is, the same as the number of the fixing holes 25, fastening members 40 are provided.

Meanwhile, a configuration in which the ink is circulated in the manifold 12 to prevent thickening of the ink can be applied, as illustrated in FIG. 3B. In a recording head 200 according to this example, an ink supply path 118A for inflow and an ink discharge path 118B for outflow are formed in a head case 215. One of the paths communicates with one end portion of the manifold 12 of a head main body 221 and the other one communicates with the other end portion of the manifold 12. Furthermore, in FIG. 3B, the same numerals are given to the same portions as those in FIG. 3A, and the same descriptions will not be repeated.

Figure 4:
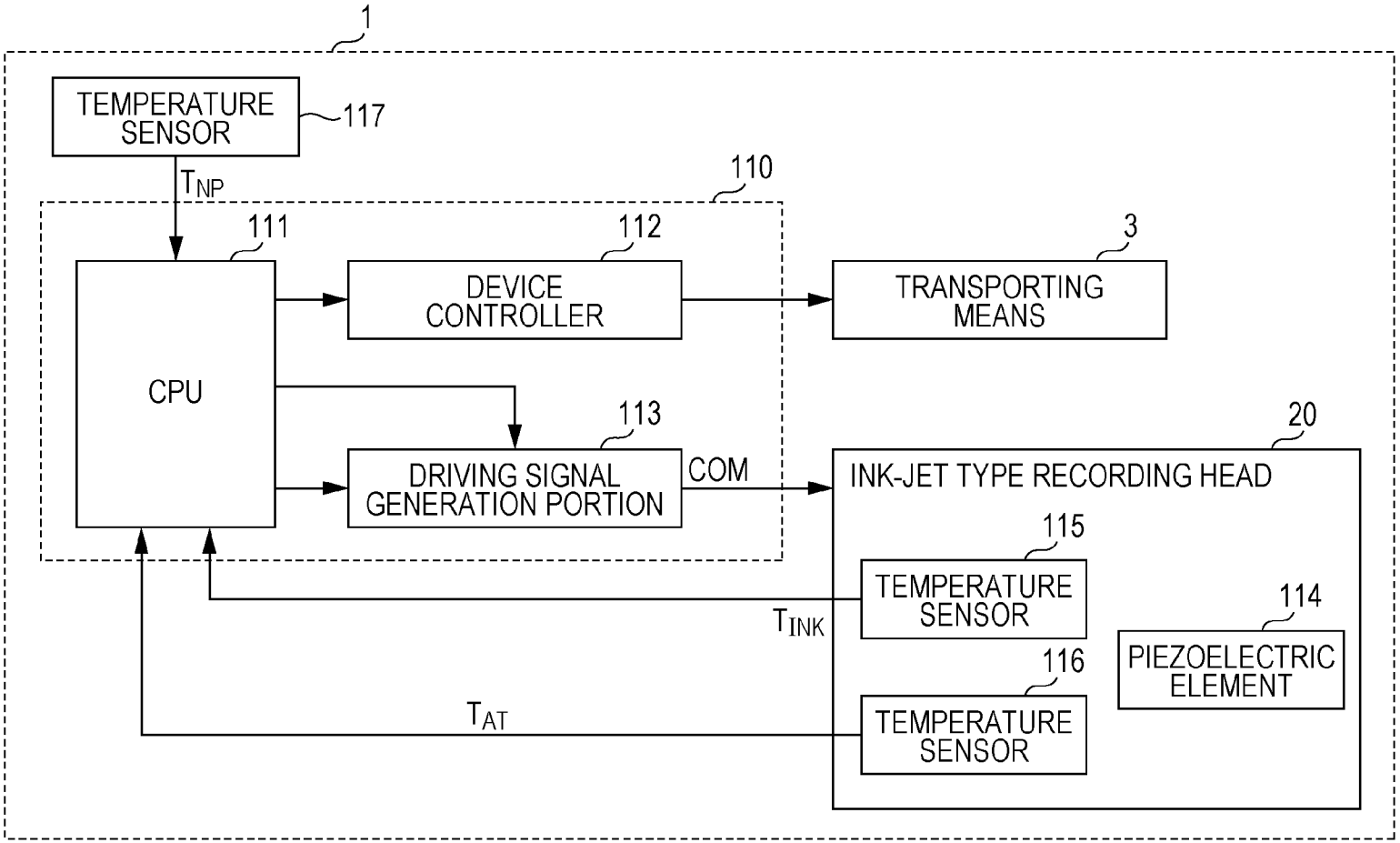
FIG. 4 is a block diagram illustrating a control system of the ink-jet type recording apparatus.

FIG. 4 is a block diagram illustrating a control system of the ink-jet type recording apparatus 1 according to this embodiment. A controller 110 that controls components of the ink-jet type recording apparatus 1 is provided in the ink-jet type recording apparatus 1, as shown in FIG. 4. The controller 110 has a CPU 111 that controls the entire ink-jet type recording apparatus 1, a device controller 112 that controls driving of the transporting unit 3 in response to the control signals from the CPU 111, and a driving-signal generation portion 113 that generates a driving signal used for driving a piezoelectric element 114. The driving-signal generation portion 113 generates a driving signal COM used for driving the piezoelectric element 114, as a capacitive load, in the recording head 20.

Therefore, when the driving signal is input from the CPU 111 to the device controller 112 for driving the transporting unit 3, the device controller 112 drives the driving rollers 5*a* and 6*a* of the first and second transporting units 5 and 6 of the transporting unit 3 and causes the recording sheet S to move in the Y direction. Then, the ink is discharged through the nozzle openings 23 to perform the predetermined printing.

Meanwhile, the driving-signal generation portion 113 adds, to the driving signal COM (details of the driving signal COM will be described below), data which corresponds to either one of a discharging mode or a fine oscillation mode of each piezoelectric element 114. Then, the driving-signal generation portion 113 generates, based on the data sent from the CPU 111, the driving signal COM corresponding to each mode. This driving signal COM is sent to the recording head 20. As a result, the driving signal COM is supplied to each piezoelectric element 114, and thus ink discharging or fine oscillating is performed.

The temperature sensor 115 detects a temperature $T_{INK}$ of the ink flowing into the head main body 21 (see FIGS. 2 to 3B; the same applies to the following description), as described above. The temperature sensor 116 detects an ambient temperature $T_{AT}$ of the head main body 21, as described above. Furthermore, the temperature sensor 117 detects a temperature $T_{NP}$ of the nozzle plate 13, as described above. This temperature $T_{NP}$ of the nozzle plate 13 is measured when gathering basic data for controlling before actual printing is performed by the recording head 20.

Figure 5:
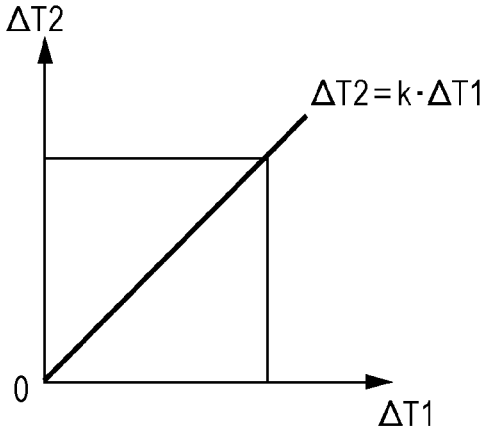
FIG. 5 is a graph illustrating the relationship between a first temperature difference and a second temperature difference.

Processes as described below are performed in the CPU 111 to which measured data obtained from the temperature sensors 115 to 117 are input. First, the relationship between a first temperature difference ΔT1, which is the temperature difference between the ink temperature $T_{INK}$ detected by the temperature sensor 115 and the ambient temperature $T_{AT}$ detected by the temperature sensor 116, and a second temperature difference ΔT2, which is the temperature difference between the ink temperature $T_{INK}$ detected by the temperature sensor 115 and the temperature $T_{NP}$ of the nozzle plate 13 (≅the temperature of the pressure generation chamber) detected by the temperature sensor 117, is calculated. As a result, property information as illustrated in FIG. 5 is obtained. This property information is stored in a memory of the CPU 111. In this case, the relationship of ΔT2=k·ΔT1 (k is a proportionality constant) is established. Therefore, k is calculated as T2/T1. The calculation result, that is, information of the proportionality constant k, is stored in the CPU 111.

In the state described above, the ink temperature $T_{INK}$ and the ambient temperature $T_{AT}$ are measured by the temperature sensors 115 and 116. Subsequently, the CPU 111 processes the measured data to obtain the measured value of the first temperature difference ΔT1. The second temperature difference ΔT2(=k·ΔT1) is calculated using the measured value information of the first temperature difference ΔT1.

Here, the temperature of the ink (which is substituted by the temperature $T_{NP}$(≅the temperature of the pressure generation chamber), in this example) discharged through the nozzle openings 13*a*, which is intended to be detected, is the sum of or the difference between the ink temperature $T_{INK}$, which is the value measured at this time, and the second temperature difference ΔT2 ($T_{NP}=T_{INK}\pm\Delta T2$).

The CPU 111 drives the piezoelectric element 114 with appropriate control of the waveforms of the driving signal COM based on the corrected ink-temperature information. Accordingly, the optimal fine-oscillation voltage correction is performed to reduce the temperature difference between discharging nozzles and non-discharging nozzles. Details of this process are as follows.

Figure 6A:
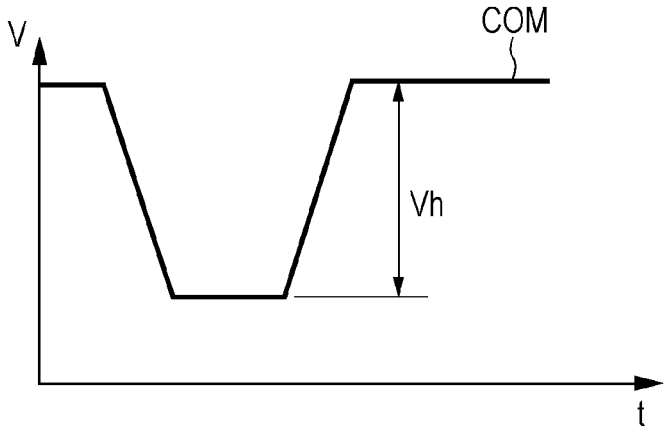
FIGS. 6A to 6C are waveform diagrams illustrating examples of various driving signals.
Figure 6B:
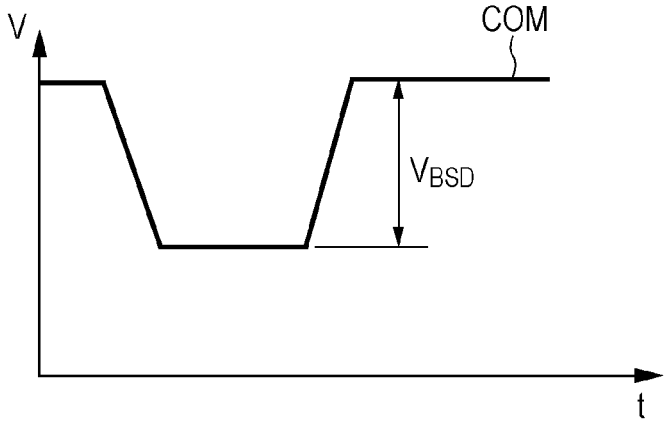
Figure 6C:
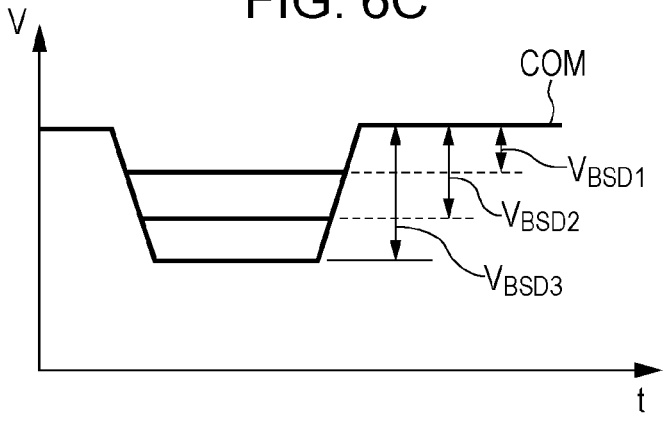

FIGS. 6A to 6C are waveform diagrams illustrating the driving signals COM according to this embodiment. The driving signal COM includes a discharge voltage Vh (see FIG. 6A) used for, based on the ink temperature, discharging ink droplets and a fine-oscillation voltage $V_{BSD}$ (see FIG. 6B) which is used for finely oscillating the meniscus of the ink without discharging the ink droplets and which corresponds to the discharge voltage, as illustrated in FIGS. 6A to 6C. Thus, the discharge voltage Vh is applied to the piezoelectric element 114 corresponding to the discharging nozzles, and the fine-oscillation voltage $V_{BSD}$ is applied to the piezoelectric element 114 corresponding to the non-discharging nozzles (fine-oscillation nozzles). In this case, the reference fine-oscillation voltage $V_{BSD}$ is multiplied by an appropriate coefficient, as illustrated in FIG. 6C, and thus corrected fine-oscillation voltages $V_{BSD1}$, $V_{BSD2}$, and $V_{BSD3}$ are obtained from the fine-oscillation voltage $V_{BSD}$. In this case, it is possible to appropriately set the coefficient, based on the measured nozzle-plate temperature $T_{NP}$ by using the data which is mapped in advance and stored in the CPU 111.

Incidentally, it is ideal to be able to measure the ink temperature in the pressure generation chamber. However, it is not possible to install the temperature sensor 115 for measuring the ink temperature at an ideal position, because of various limitations. Thus, in the case of this embodiment, the temperature sensor 115 is installed at the position adjacent to the ink supply path 118 in the head case 15 and measures the ink temperature $T_{INK}$. Meanwhile, the temperature sensor 116 for measuring the ambient temperature $T_{AT}$ is installed at the position adjacent to the nozzle plate 13. In the case of this configuration, the temperature sensor 115 for measuring the ink temperature is separated from the pressure generation chamber, and thus the ink temperature $T_{INK}$ varies with the ambient temperature change while the ink flows from an ink-temperature measuring point to the pressure generation chamber.

In the case of this embodiment, the temperature correction is performed by experimentally obtaining, in advance, the relationship between the temperature difference ΔT1, which is the temperature difference between the measured ink-temperature detected by the temperature sensor 115 and the measured ambient-temperature detected by the temperature sensor 116 and the temperature difference, which is the temperature difference between the measured ink-temperature detected by the temperature sensor 115 and the temperature of the nozzle plate 13 (≅the ink temperature in the pressure generation chamber). In other words, the corrected fine-oscillation voltages $V_{BSD1}$, $V_{BSD2}$, and $V_{BSD3}$ which are appropriate to perform the fine-oscillation voltage correction optimal to reduce the temperature difference between the discharging nozzles and the non-discharging nozzles are generated using the corrected temperature subjected to processes described above.

Figure 7A:
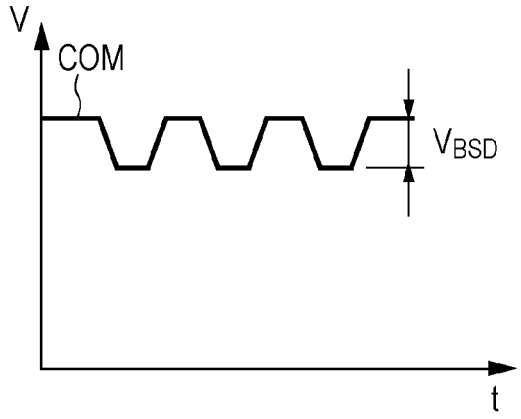
FIGS. 7A to 7C are waveform diagrams illustrating other examples of various driving signals.
Figure 7B:
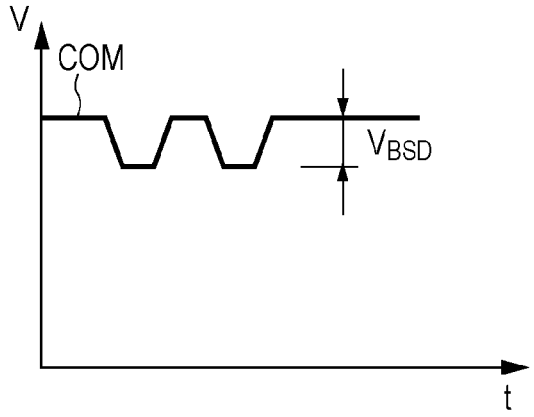
Figure 7C:
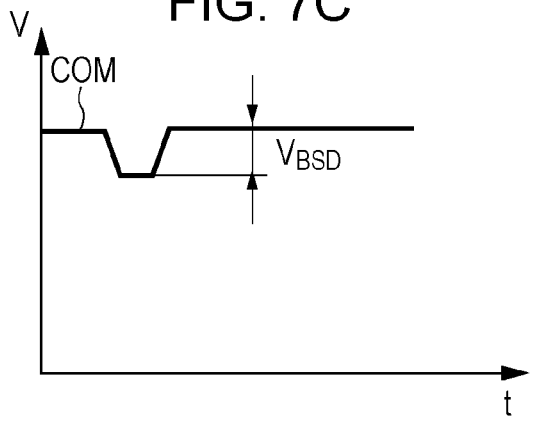

The reduction of the temperature difference between the discharging nozzles and the non-discharging nozzles can be achieved not only by the way of correcting the fine-oscillation voltage as described above, but also by the way of changing the number of application times, corresponding to the predetermined coefficient, of the fine-oscillation voltage $V_{BSD}$ within the predetermined period to control the fine-oscillation energy level. More specifically, based on the coefficient particular to the temperature $T_{NP}$ of the nozzle plate 13, which is calculated through the processes described above, the number of application times of the fine-oscillation voltage $V_{BSD}$ within the predetermined period is changed, as illustrated in FIGS. 7A to 7C. The number of the application times of the fine-oscillation voltage $V_{BSD}$ is, for example, three times as illustrated in FIG. 7A, twice as illustrated in FIG. 7B, or once as illustrated in FIG. 7C. It is possible to adjust, by using the method described above, the energy level of the fine oscillation.

Here, it is also possible to regulate a voltage correction range of the fine-oscillation voltage $V_{BSD}$. In other words, it is possible to conceive that the voltage range of the fine-oscillation voltage $V_{BSD}$ may be set to be in the range of between a lower voltage limit (equal to or more than 10% of the discharge voltage Vh, for example) for preventing thickening of the ink discharged through the nozzle openings 13*a* and an upper voltage limit (equal to or less than 80% of the discharge voltage Vh, for example) for preventing erroneous ink discharge.

In this case, the voltage correction of the fine-oscillation voltage $V_{BSD}$ may be suppressed at or below the upper limit described above. Further, when the e voltage correction of the fine-oscillation voltage $V_{BSD}$ exceeds the upper limit, the number of application times of the fine-oscillation voltage $V_{BSD}$ within the predetermined period may be changed, as illustrated in FIGS. 7A to 7C. In this case, the number of application times of the fine-oscillation voltage $V_{BSD}$ is changed without reducing the driving frequency. Thus, it is possible to set the temperatures of the discharging nozzles and the non-discharging nozzles to be equal, while suppressing the erroneous ink discharge and preventing the reduction in the printing speed.

Hereinbefore, the embodiment of the invention is described. However, the basic configuration of the invention is not limited thereto. The setting method is not particularly limited as long as the coefficient is set in accordance with the difference between the liquid temperature and the ambient temperature, and thus the temperature of the liquid droplets discharged through the nozzle openings can be reflected more accurately, for example. In addition, setting of the upper limit and the lower limit of the fine-oscillation voltage is optional. However, if the upper limit is set, it is possible to prevent the erroneous ink discharge when the fine oscillation is performed. In addition, if the lower limit is set, it is possible to appropriately prevent the thickening of the liquid.

Furthermore, in the case of the embodiment described above, the invention can be applied to a so-called serial-type recording device in which the recording head 20 is mounted in a carriage and moves in a main scanning direction.

The invention is intended to be applied, widely, to a general liquid ejecting head. Examples of the liquid ejecting head include recording heads, such as various ink-jet type recording heads applied to image recording apparatuses, such as printer, a coloring-material ejecting head which is used for manufacturing a color filter, such as a liquid crystal display, an electrode-material ejecting head which is used for forming an electrode of an organic EL display, a field emission display (FED), or the like, and a bioorganic material ejecting head which is used for manufacturing a biochip. Needless to say, a liquid ejecting apparatus equipped with such a liquid ejecting head is also particularly not limited.

What is claimed is:

1. A liquid ejecting apparatus that has a liquid ejecting head in which pressure in each pressure generation chamber is changed by each of a plurality of pressure generation units, and thus liquid in the pressure generation chamber is discharged, as liquid droplets, through nozzle openings and that has a controller including a driving signal generation unit which generates a driving signal used for operating the pressure generation units, the liquid ejecting apparatus comprising:

a first temperature sensor that detects temperature of the liquid; and a second temperature sensor that detects ambient temperature of the liquid ejecting head, wherein the controller generates a driving signal including a discharge voltage which is used for, based on a temperature detected by the first temperature sensor, discharging the liquid droplets through the nozzle openings and a fine-oscillation voltage which is used for finely oscillating meniscuses of the liquid without discharging the liquid droplets and corresponds to the discharge voltage, wherein the controller sets a coefficient in accordance with a temperature difference between the temperature of the liquid detected by the first temperature sensor and the ambient temperature detected by the second temperature sensor and controls an energy level of the fine oscillation by applying the fine-oscillation voltage, based on the coefficient, and wherein the controller causes the discharge voltage to be applied to the pressure generation unit corresponding to nozzle openings through which the liquid droplets are discharged and causes the fine-oscillation voltage to be applied to the pressure generation unit corresponding to nozzle openings through which the liquid droplets are not discharged.

2. The liquid ejecting apparatus according to claim 1, wherein the driving signal includes a corrected fine-oscillation voltage of which a voltage value is changed by multiplying a reference fine-oscillation voltage corresponding to the discharge voltage by the coefficient and controls the energy level of the fine oscillation by applying the corrected fine-oscillation voltage.

3. The liquid ejecting apparatus according to claim 1, wherein the driving signal controls the energy level of the fine oscillation by applying the fine-oscillation voltage in such a manner that the number of application times of the fine-oscillation voltage within a predetermined period is changed in accordance with the coefficient.

4. The liquid ejecting apparatus according to claim 1, wherein a proportionality constant is determined based on a relationship of (a second temperature difference $\Delta T2$) $=k\cdot$(a first temperature difference $\Delta T1$) which is established between the first temperature difference, between the liquid temperature detected by the first temperature sensor and the ambient temperature detected by the second temperature sensor, and the second temperature difference, between the liquid temperature detected by the second temperature sensor and a nozzle-plate temperature detected separately, and in which k is the proportionality constant, and wherein the liquid temperature and the ambient temperature are measured by the first and second temperature sensors and a measured value of the first temperature difference is obtained based on the measured data, and thus the second temperature difference is calculated using the measured value of the first temperature difference and the proportionality constant, and the coefficient is determined to meet a condition in which temperature of the liquid droplets discharged through the nozzle openings is a value obtained by adding the calculated value of the second temperature difference to the measured value of the liquid temperature, which is a value detected by the first temperature sensor, or subtracting the calculated value of the second temperature difference from the measured value of the liquid temperature.

5. The liquid ejecting apparatus according to claim 1, wherein the fine-oscillation voltage is controlled to be set in the range of between a lower voltage limit for preventing thickening of liquid and an upper voltage limit for preventing erroneous liquid discharge through the nozzle openings.

6. The liquid ejecting apparatus according to claim 1, wherein the fine-oscillation voltage is controlled to be set in the range of between a lower voltage limit for preventing thickening of liquid and an upper voltage limit for preventing erroneous liquid discharge through the nozzle openings, and wherein, when the fine-oscillation voltage exceeds the upper limit voltage, the number of application times of the reference non-discharge voltage within a predetermined period is controlled to be increased.

* * * * *